US010276945B2

(12) United States Patent
Komiak

(10) Patent No.: US 10,276,945 B2
(45) Date of Patent: Apr. 30, 2019

(54) MONOLITHIC QUAD SWITCH FOR RECONFIGURABLE ANTENNAS

(71) Applicant: BAE SYSTEMS INFORMATION AND ELECTRONIC SYSTEMS INTEGRATION INC., Nashua, NH (US)

(72) Inventor: James J. Komiak, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 209 days.

(21) Appl. No.: 15/098,510

(22) Filed: Apr. 14, 2016

(65) Prior Publication Data

US 2017/0302002 A1 Oct. 19, 2017

(51) Int. Cl.

| | |
|---|---|
| ***H01Q 3/24*** | (2006.01) |
| ***H01Q 1/38*** | (2006.01) |
| ***H01Q 21/06*** | (2006.01) |
| *H01Q 1/28* | (2006.01) |

(52) U.S. Cl.

CPC ..... *H01Q 21/06* (2013.01); *H01Q 1/281* (2013.01)

(58) Field of Classification Search

None

See application file for complete search history.

(56) References Cited

U.S. PATENT DOCUMENTS

| | | | | |
|---|---|---|---|---|
| 7,683,844 | B2 * | 3/2010 | Alamouti | H01Q 1/38 343/754 |
| 2002/0158710 | A1 * | 10/2002 | Penn | H01P 1/185 333/164 |
| 2003/0080829 | A1 * | 5/2003 | Lampen | H03H 7/20 333/164 |
| 2004/0095288 | A1 * | 5/2004 | Jackson | H01Q 3/40 343/853 |
| 2007/0013460 | A1 * | 1/2007 | Buer | H03H 7/20 333/164 |
| 2007/0016026 | A1 * | 1/2007 | Thomenius | G01S 7/5208 600/437 |
| 2009/0184864 | A1 * | 7/2009 | Barak | H01L 23/66 342/175 |
| 2012/0242410 | A1 * | 9/2012 | Darwish | H03F 1/0266 330/288 |
| 2013/0109331 | A1 * | 5/2013 | Lee | H04B 1/48 455/78 |
| 2014/0184334 | A1 * | 7/2014 | Nobbe | H03F 1/0227 330/291 |
| 2014/0287704 | A1 * | 9/2014 | Dupuy | H04B 1/0475 455/114.2 |
| 2015/0270806 | A1 * | 9/2015 | Wagh | H03F 3/211 330/296 |

* cited by examiner

*Primary Examiner* — Trinh V Dinh

(74) *Attorney, Agent, or Firm* — Sand, Sebolt & Wernow LPA; Scott J. Asmus

(57) ABSTRACT

A phased array antenna which can change the configuration of the phased array antenna by controllable quad switches on the phased array antenna is presented. The phased array antenna adapts monolithic microwave integrate circuit (MMIC) technology to have high isolation interconnection of the reconfigurable phased array antenna. The reconfigurable phased array antenna can be reusable and adaptable to different configurations so that the overall cost and lead time of the phased array antenna is reduced compared to the existing RF antennas in the market.

14 Claims, 7 Drawing Sheets

MONOLITHIC QUAD SWITCH FOR RECONFIGURABLE ANTENNAS

STATEMENT OF GOVERNMENT INTEREST

This invention was made with United States Government support under Contract No. HR0011-14-C-0056 awarded by the DEFENSE ADVANCED RESEARCH DEPARTMENTS AGENCY. The United States Government has certain rights in this invention

BACKGROUND

Technical Field

Generally, the current disclosure relates to radio frequency (RF) antennas and more particularly to a reconfigurable phased array antenna. Specifically, the current disclosure is directed to a modular reconfigurable antenna regarding components that are reusable and easily adaptable to different configurations so that the overall cost of the system is less than current phased array RF antennas.

Background Information

Conventionally, a phased array antenna is not reconfigurable so that different phased array configurations have to be provided for each unique application. The conventional method of fabricating different shapes of a phased array antenna would incur relatively high cost to develop, design, and test. Furthermore, since each phased array antenna has to be fabricated using its own process, it requires extra research and a long lead time (the time from the beginning of the design process to the ending of the fabrication process).

Additionally, the conventional approach of fabricating a phased array antenna has many disadvantages. First, the conventional method is limited in size, bandwidth, and performance of an antenna due to the lack of availability of mounting discrete packaged SMT (surface mount technology) components with unsuitable topologies and parasitics. Additionally, due to the antenna's non-linearity, predictions of results are not possible, and most frequently, results do not correlate with measurements.

However, through the use of monolithic microwave integrate circuit (MMIC) technology, low loss and high isolation interconnection of a reconfigurable phased array antenna can be achieved. Monolithic microwave integrate circuit (MMIC) is a type of integrated circuit (IC) that operates at microwave frequencies (300 MHz to 300 GHz). Particularly, MMIC technology has small dimensions (from around 1 $mm^2$ to 10 $mm^2$) and allows combining both passive and active devices on a single substrate so that the MMIC can reduce the size of the device and the numbers of components resulting in enhancing manufacturing yield rate.

SUMMARY

In one aspect, the embodiment of the present disclosure may provide a unit cell device for a reconfigurable phased array antenna comprising at least one floating switch, at least one RF connection port operatively connected with the at least one floating switches, at least one radiating metal conductor operatively connected to the at least one floating switch, and at least one control voltage pad operatively connected to the at least one floating switch.

Generally, MMIC is fabricated using gallium arsenide (GaAs), a III-V compound semiconductor, rather than silicon (Si) because of device (transistor) speed. Unlike the conventional series/shunt topologies which do not work due to the lack of ground reference, by using MMIC, the present disclosure antenna made out of GaAs does not have any limitation in size, bandwidth, and performance by availability of packaged SMT components. Furthermore, using MMIC, the size of the present disclosure antenna can be arbitrarily adjustable; the antenna has wide bandwidth; the performance of the antenna is enhanced; and the performance can be easily predictable. Additionally, the phased array antenna integrated with MMIC can be integrated to higher levels and can use metal as a patch radiator which forms a monolithic tile. A novel and improved way of fabricating a reconfigurable phased array antenna by Monolithic Microwave Integrate Circuit (MMIC) technology is presented.

In another aspect, the embodiment of the present disclosure may have a method comprises providing a reconfigurable phased array antenna including at least one floating switch, at least one RF connection port operatively connected with the at least one floating switches, at least one radiating metal conductor operatively connected to the at least one floating switch, and at least one control voltage pad operatively connected to the at least one floating switch, establishing a first configuration of the reconfigurable phased array antenna having a first current flow pattern, reconfiguring the reconfigurable phased array antenna, and establishing a second configuration of the reconfigurable phased array antenna having a second current flow pattern different than the first current flow pattern.

A unit cell device for a reconfigurable phased array antenna comprising at least one floating switch; at least one RF connection port operatively connected with the at least one floating switches; at least one radiating metal conductor operatively connected to the at least one floating switch; and at least one control voltage pad operatively connected to the at least one floating switch.

A phased array antenna which can change the configuration of the phased array antenna by controllable quad switches on the phased array antenna is presented. The phased array antenna adapts monolithic microwave integrate circuit (MMIC) technology to have high isolation interconnection of the reconfigurable phased array antenna. The reconfigurable phased array antenna can be reusable and adaptable to different configurations so that the overall cost and lead time of the phased array antenna is reduced compared to the existing RF antennas in the market.

BRIEF DESCRIPTION OF THE DRAWINGS

A sample embodiment of the disclosure is set forth in the following description, is shown in the drawings and is particular and distinctly pointed out and set forth in the appended claims. The accompanying drawings, which are fully incorporated herein and constitute a part of the specification, illustrate various examples, methods, and other example embodiments of various aspects of the invention. It will be appreciated that the illustrated element boundaries (e.g., boxes, group of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION OF THE EMBODIMENT

Figure 1:
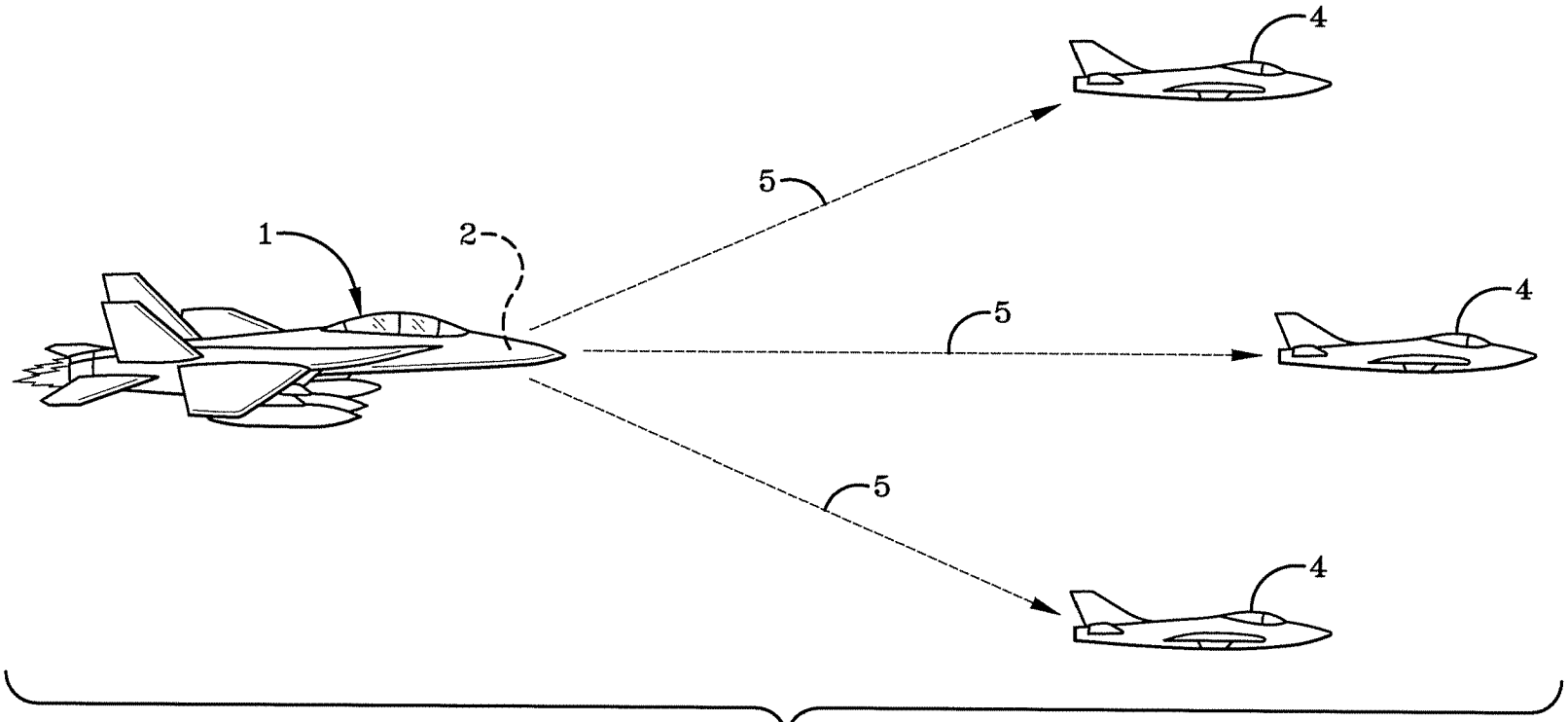
FIG. 1 is an exemplary environmental schematic view of a phased array antenna applied on an aircraft.
Figure 2:
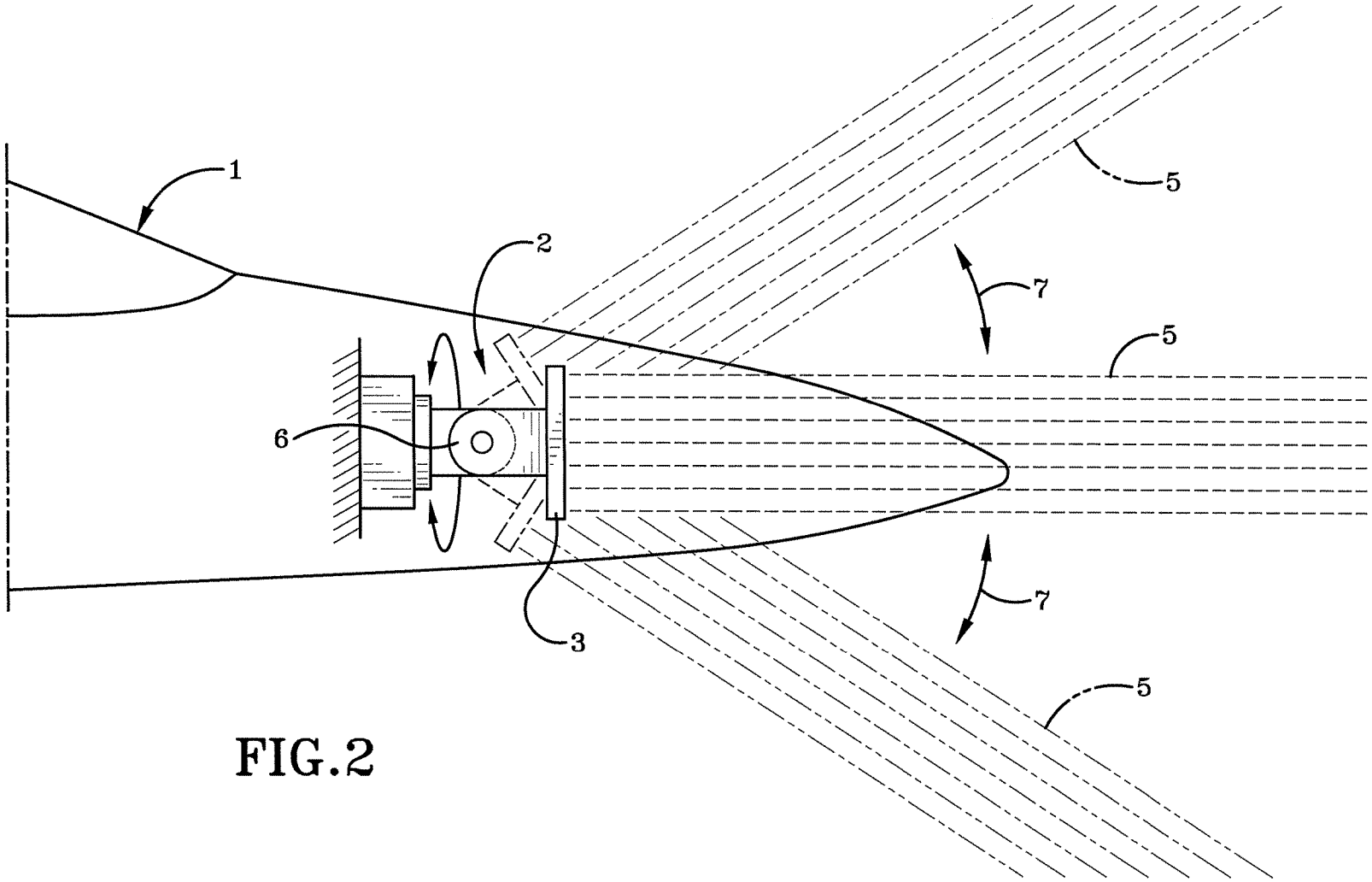
FIG. 2 is a detailed view of the phased array antenna system mounted on the aircraft.

The current disclosure pertaining to a reconfigurable phased array antenna which can be mounted on an aircraft. As depicted in FIG. 1, a radar system 2 is mounted on an aircraft 1 to detect enemy fighters 4. More particularly, as depicted in FIG. 2, radar system 2 which is mounted on a gimbal axis 6 is used to locate a phased array antenna 3 to a certain direction. In FIGS. 1 and 2, aircraft 1 is depicted as a jet but may be any other form of flying device as one having ordinary skill in the art would understand.

By way of a brief introduction, radar system 2 comprises the phased array antenna 3 which is designed to emit an electromagnetic wave signals and detect the electromagnetic wave signal returning from any object (flying or non-flying) so that antenna 3 can measure the distance from the object and detect the direction of the object to protect aircraft 1 from any in-coming threat such as infrared homing ("heat seeking") missiles. Unlike other conventional antennas, phased array antenna 3 is composed of a number of single unit cell antennas.

Generally, a signal from each single unit cell antenna is combined with other signals and processed in order to achieve improved performance. More specifically, phased array antenna 3 is composed of many radiating elements including a phase shifter.

In a conventional radar system, if the radar sends the same amount of electromagnetic wave signal in all directions (360°) then it is not possible to determine where the specific electromagnetic wave is bounced back from. Thus, it is very desirable to design an antenna which can detect an electromagnetic wave returning from a specific direction. Contrastingly, in phased array antenna 3, electromagnetic wave signals are formed by shifting the phase of the signal emitted from each radiating element to provide constructive or destructive interference so as to steer the beams in the desired direction 5 as shown in FIGS. 1 and 2. Additionally, "reconfigurable" means that the interconnection of arrays is not fixed, rather a shape of a phased array antenna can be reconfigured. Thus, as a shape of a phased array antenna has been changed, the characteristic of a phased array antenna is also altered because the characteristic of a phased array antenna depends on a shape of a phased array antenna. More particularly, unlike other conventional phased array antennas, the reconfigurable phased array antenna 3 has several advantages over the conventional phased array antennas. That is, the reconfigurable phased array antenna 3 would be inexpensive, adaptable, reusable, and minimal lead time due to its design flexibility, whereas the conventional approach of fabricating a phased array antenna is designated only for a certain type of an antenna.

Figure 3:
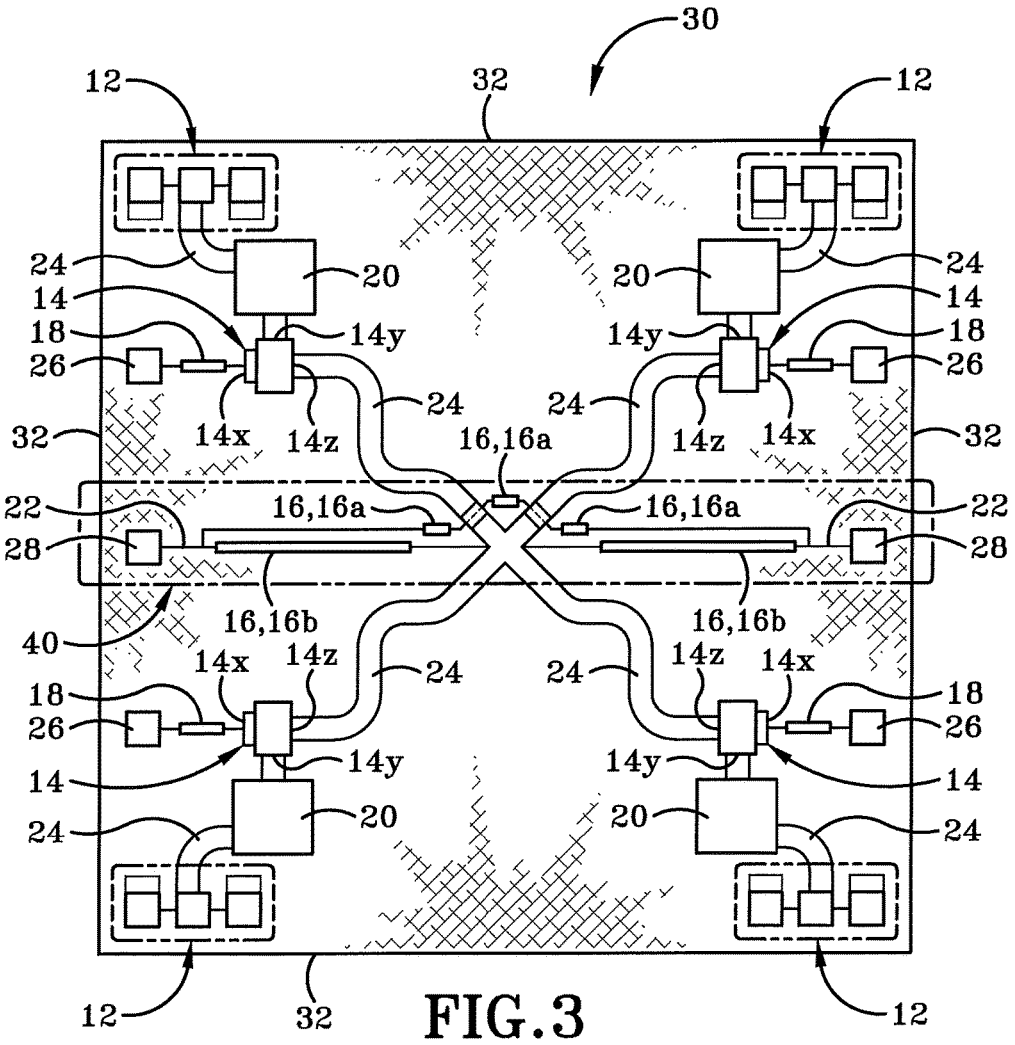
FIG. 3 is a schematic drawing showing an overview of a quad switch layout.
Figure 4:
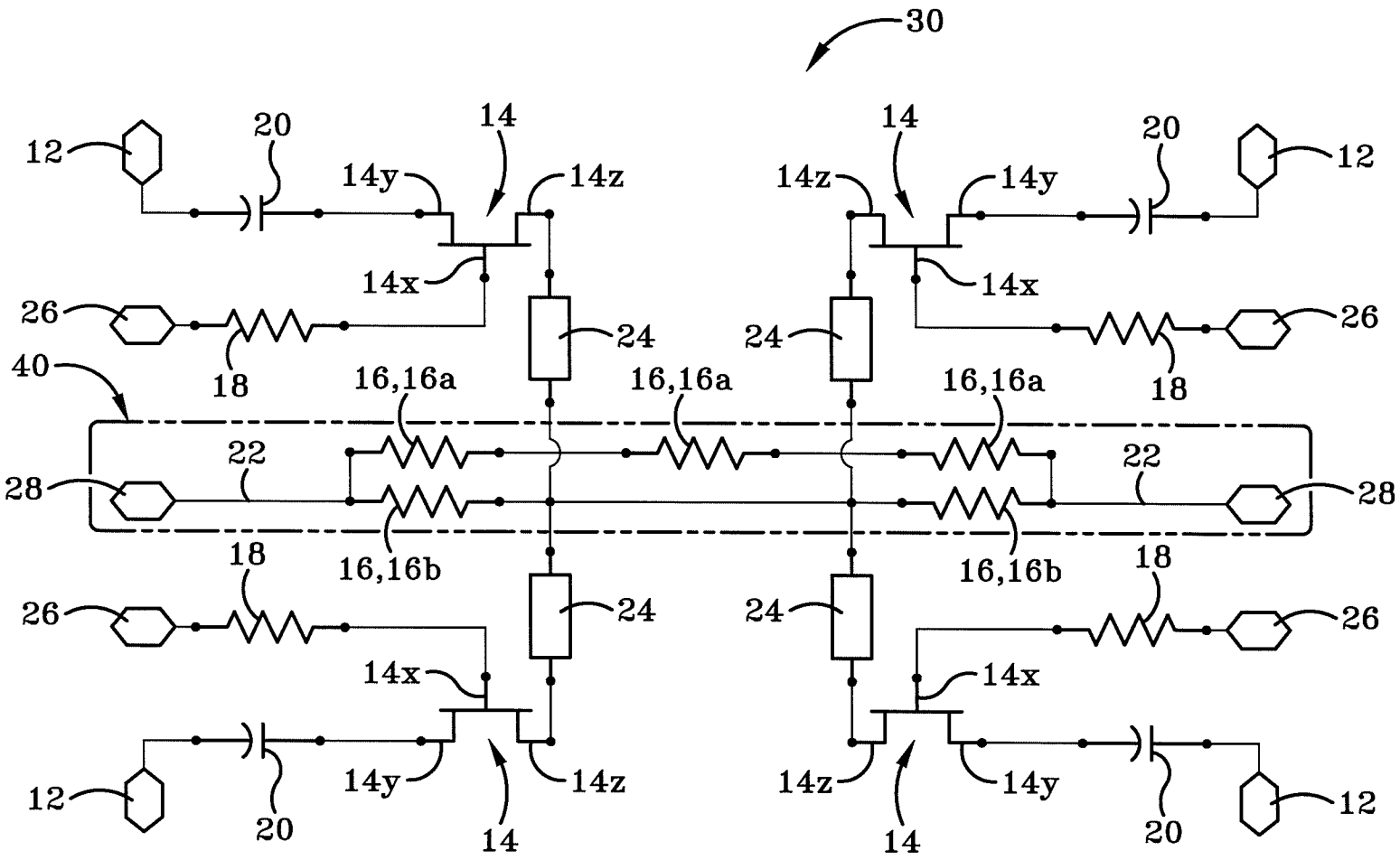
FIG. 4 is a simplified first schematic of a monolithic quad switch.

As depicted in FIGS. 3 and 4, the basis for a reconfigurable antenna 3 is quad switches employing four switch device cells connected in series with a common RF junction and bias circuitry. Particularly, in one embodiment, each unit cell device 30 of the reconfigurable phased array antenna 3 comprises four RF connection ports 12, four floating series of pHEMT (pseudomorphic high-electron-mobility transistor) switches (quad switches) 14, bias voltage return resistors 16, bias voltage resistor 18, four DC block capacitors 20, bias voltage retuning metal interconnector 22, four radiating metal conductors 24, four control voltage pads 26, and two control return pads 28. However, different types of series switching devices can be used to replace pHEMT switches.

Particularly, as depicted in FIG. 3, each unit cell device 30 has a rectangular shape. Each unit cell device 30 has its four peripheral edges 32. Four RF connection ports 12 are located at the four corners of each unit cell device 30. Each RF connection port 12 in unit cell device 30 can be used to connect to quad switches 14 of other unit cell devices 30. Furthermore, eventually, each unit cell device 30 can be gathered and connected to form a panel which comprises a numbers of unit cell devices 30 in the form of arrays. Floating pHEMT switch 14 is a field effect type transistor, thus, floating pHEMT switch 14 has a gate 14*x*, a drain 14*y*, a source 14*z*. A line extends from RF connection port 12 to drain 14*y* of floating pHEMT switch 14. In one embodiment, DC block capacitor 20 has a capacitance of 20 pF and is connected between RF connection port 12 and drain 14*y* of floating pHEMT switch 14. DC block capacitor 20 is used to protect the system from any damage caused by DC signal. However, in another embodiment, DC block capacitor 20 can be eliminated if a low end bandwidth of the DC signal is limited effectively. Gate 14*x* on each floating pHEMT switch 14 is directly connected with one of control voltage pads 26. Additionally, bias voltage resistor 18 with the resistance value of 2 Kohm is directly connected between control voltage pad 26 and gate 14*x*. Finally, source 14*z* on each floating pHEMT switch 14 is directly connected with one of radiating metal conductors 24.

Particularly, as shown in FIG. 3, the entire path from RF connection ports 12 to common cross junction 40 forms radiating metal conductor 24. However, comparatively, as shown in FIG. 4, radiating metal conductor 24 can be reduced to a solid radiating element which has equivalent width of 70 μm and length of 500 μm. Radiating metal conductor 24 is typically made out of gold (Au). However, it can be made with any other conducting materials such as aluminum, copper or nickel. As described, each radiating metal conductor 24 is now connected with common cross junction 40.

As depicted in FIGS. 3 and 4, there are total of four of floating pHEMT switches 14 on each unit cell device 30. All of floating pHEMT switches 14 are connected in series with common cross junction 40. Common cross junction 40 comprises five bias voltage return resistors 16, two bias voltage retuning metal interconnector 22, and two control return pads 28. Particularly, among five bias voltage return resistors 16, the top three resistors 16*a* are cross over resistors with the resistance value of 500 ohm, and the bottom two resistors 16*b* have a resistance of 10 Kohm respectively. Common cross junction 40 is necessary to provide control voltage return to reference voltage. Since quad switch control voltage is floating, bias is introduced through a control connection, thus a return connection for reference is needed.

Additionally, due to the complexity of the bias circuitry, "daisy chained" common bias ports are provided as a reference voltage with common cross junction 40. In unit cell device 30, each RF connection port 12 may be connected to a central RF feed to provide an electric signal to drain 14*y* of floating pHEMT switch 14. Each control voltage pad 26 may be connected with an outer voltage source to provide certain amount of voltage to control a gate voltage of floating pHEMT switch 14. Lastly, control return pad 28 may be connected with an outer ground source.

Each unit cell device 30 is fabricated on a GaAs (Gallium Arsenide) substrate implemented by monolithic microwave integrated circuit (MMIC) technology, wherein the MMIC technology consists of FETs, resistors, silicon nitride dielectric capacitors and coplanar metal interconnects. Although a silicon (Si) substrate is more widely used than a GaAs substrate in the field of microelectronic fabrication, a GaAs substrate is selected over a Si substrate since GaAs shows the better performance and manufacturability for a phased array antenna as integrated with MMIC technology.

Operatively, floating pHEMT switch 14 is used as a switching device so that it allows unit cell device 30 to be reconfigurable by interconnecting/disconnecting various radiating metal conductors 24. The current between drain 14*y* and source 14*z* on each floating pHEMT switch 14 depends on the voltage of gate 14*x* on each floating pHEMT switch 14. Thus, controlling the voltage on gate 14*x* on each pHEMT switch 14 enables the pHEMT switch 14 to be turned on or turned off. Since floating pHEMT switch 14 is connected with radiating metal conductors 24, by electrically turning on or off floating pHMET switch 14, electrical current can flow or cannot flow into radiating metal conductor. Additionally, since four floating pHEMT switches 14 are independent from each other, different configurations of phased array antenna 3 can be achieved by manipulating each individual floating pHEMT switch 14. For example, all four floating pHEMT switches 14 can be turned on simultaneously or only one of four switches 14 can be turned on.

Figure 5:
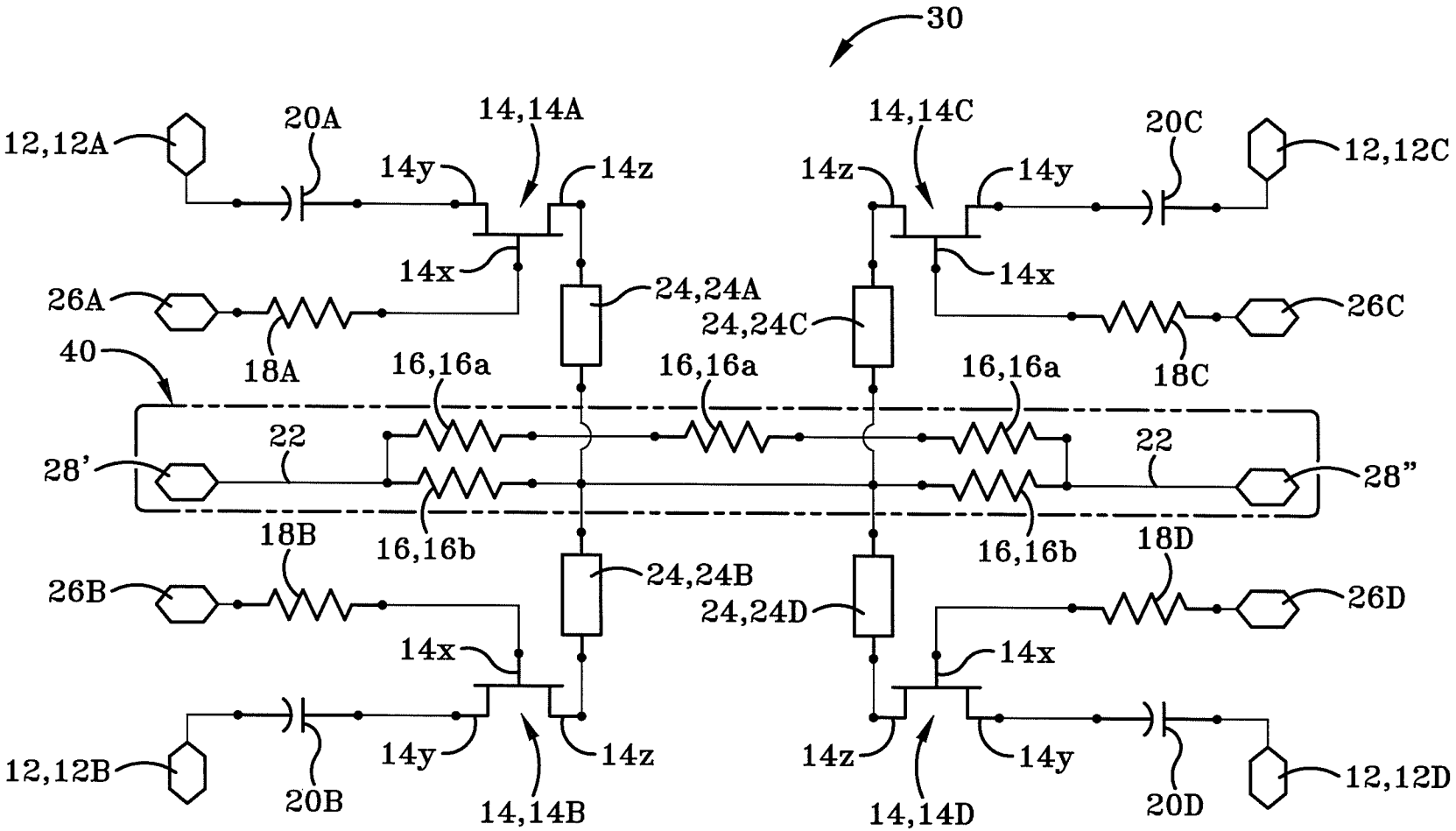
FIG. 5 is a second schematic of a monolithic quad switch.

FIG. 5 depicts further clarification of the reconfigurable operation of a unit cell 30. A first floating pHEMT switch 14 is identified as 14A, and other components are identified with a letter element after the reference numeral (i.e., 12A, 14A, and 24A,). The other floating pHEMT switches 14 have corresponding letter elements after the reference numerals (i.e., 14B, 24B; 14C, 24C; and 14D, 24D).

Example 1. Single Switch is On and the Other Switches are Off

As depicted in FIG. 5, when first floating pHEMT switch 14A is on and second, third, and fourth floating pHMET switches 14B, 14C, and 14D are off, electric current flows from first RF connection port 12A, through first pHEMT floating switch 14A and first radiating metal conductor 24A, to a first control return pads 28' through common cross junction 40. Furthermore, when second floating pHEMT switch 14B is on and first, third, and fourth floating pHMET switches 14A, 14C, and 14D are off, electric current flows from second RF connection port 12B, through second pHEMT floating switch 14B and second radiating metal conductor 24B, to one of control return pads 28' through common cross junction 40. Still furthermore, when third floating pHEMT switch 14C is on and first, second, and fourth floating pHMET switches 14A, 14B, and 14D are off, then current flows from third RF connection port 12C, through third pHEMT floating switch 14C and third radiating metal conductor 24C, to a second control return pads 28" through common cross junction 40. Finally, when fourth floating pHEMT switch 14D is on and first, second, and third floating pHMET switches 14A, 14B, and 14C are off, then current flows from fourth RF connection port 12D, then current flows from fourth RF connection port 12D, through fourth pHEMT floating switch 14D and fourth radiating metal conductor 24D, to the second control return pads 28" through common cross junction 40.

Example 2. Two Switches are On and the Other Two Switches are Off

As depicted in FIG. 5, when first and second floating pHEMT switches 14A and 14B are on and the other switches 14C and 14D are off, then a first current flows from first RF connection pad 12A to the first control return pads 28' through common cross junction 40 and, at the same or similar time, a second current flows from second RF connection pad 12B to the second control return pads 28" through common cross junction 40. When third and fourth floating pHEMT switches 14C and 14D are on and the other switches 14A and 14B are off, then a first current flows from third RF connection pad 12C to the first control return pads 28' through common junction 40 and, at the same or similar time, a second current flows from fourth RF connection pad 12D to the second control return pads 28" through common cross junction 40.

When first and third floating pHEMT switches 14A and 14C are on and the other switches 14B and 14D are off, then a first current flows from first RF connection pad 12A to one of control return pads 28' or 28" through common junction 40 and, at the same or similar time, a second current flows from third RF connection pad 12C to one of control return pads 28' or 28" through common cross junction 40. When second and fourth floating pHEMT switches 14B and 14D are on and the other switches 14A and 14C are off, then a first current flows from second RF connection pad 12B to one of control return pads 28 through common junction 40 and, at the same or similar time, a second current flows from fourth RF connection pad 12D to one of control return pads 28 through common cross junction 40.

When first and fourth floating pHEMT switches 14A and 14D are on and the other switches 14B and 14C are off, then a first current flows from first RF connection pad 12A to one of control return pads 28' or 28" through common junction 40 and, at the same or similar time, a second current flows from fourth RF connection pad 12D to one of control return pads 28' or 28" through common cross junction 40. When second and third pHEMT switches 14B and 14C are on and the other switches are off 14A and 14D, then a first current flows from second RF connection pad 12B to one of control return pads 28' or 28" through common junction 40 and, at the same or similar time, a second current flows from third RF connection pad 12C to one of control return pads 28' or 28" through common cross junction 40.

Example 3. Three Switches are On and the Other Switch is Off

As depicted in FIG. 5, when first, second, and third 14A, 14B, and 14C switches are on and fourth switch 14D is off, then a first current flows from first RF connection pad 14A to one of control return pads 28' or 28" through common junction 40, at the same or similar time, a second current flows from second RF connection pad 14B to one of control return pads 28' or 28" through common junction 40, and, at the still same time, a third current flows from third RF connection pad 14C to one of control return pads 28' or 28" through common junction 40.

When first, second, and fourth 14A, 14B, and 14D switches are on and third switch 14C is off, then a first current flows from first RF connection pad 14A to one of control return pads 28' or 28" through common junction 40, a at the same or similar time, a second current flows from second RF connection pad 14B to one of control return pads 28' or 28" through common junction 40, and, at the still same time, a fourth current flows from third RF connection pad 14C to one of control return pads 28' or 28" through common junction 40.

When first, third, and fourth 14A, 14C, and 14D switches are on and second switch 14B is off, then a first current flows from first RF connection pad 14A to one of control return pads 28' or 28" through common junction 40, at the same or similar time, a second current flows from third RF connection pad 14C to one of control return pads 28' or 28" through common junction 40, and, at the still same time, a fourth current flows from third RF connection pad 14D to one of control return pads 28' or 28" through common junction 40.

When second, third, and fourth 14B, 14C, and 14D switches are on and first switch 14A is off, then a first current flows from second RF connection pad 14B to one of control return pads 28' or 28" through common junction 40, at the same or similar time, a second current flows from third RF connection pad 14C to one of control return pads 28' or 28" through common junction 40, and, at the still same time, a fourth current flows from fourth RF connection pad 14D to one of control return pads 28' or 28" through common junction 40.

Example 4. Four Switches are On and None of the Switch is Off

As depicted in FIG. 5, when first, second, third, and fourth 14A, 14B, 14C, and 14D switches are on and none of switch is off, then a first current flows from first RF connection pad 14A to one of control return pads 28' or 28" through common junction 40, at the same or similar time, a second current flows from second RF connection pad 14B to one of control return pads 28' or 28" through common junction 40, at the still same time, a third current flows from third RF connection pad 14C to one of control return pads 28' or 28" through common junction 40, and, at the still same time, a fourth current flows from fourth RF connection pad 14D to one of control return pads 28' or 28" through common junction 40.

Figure 6:
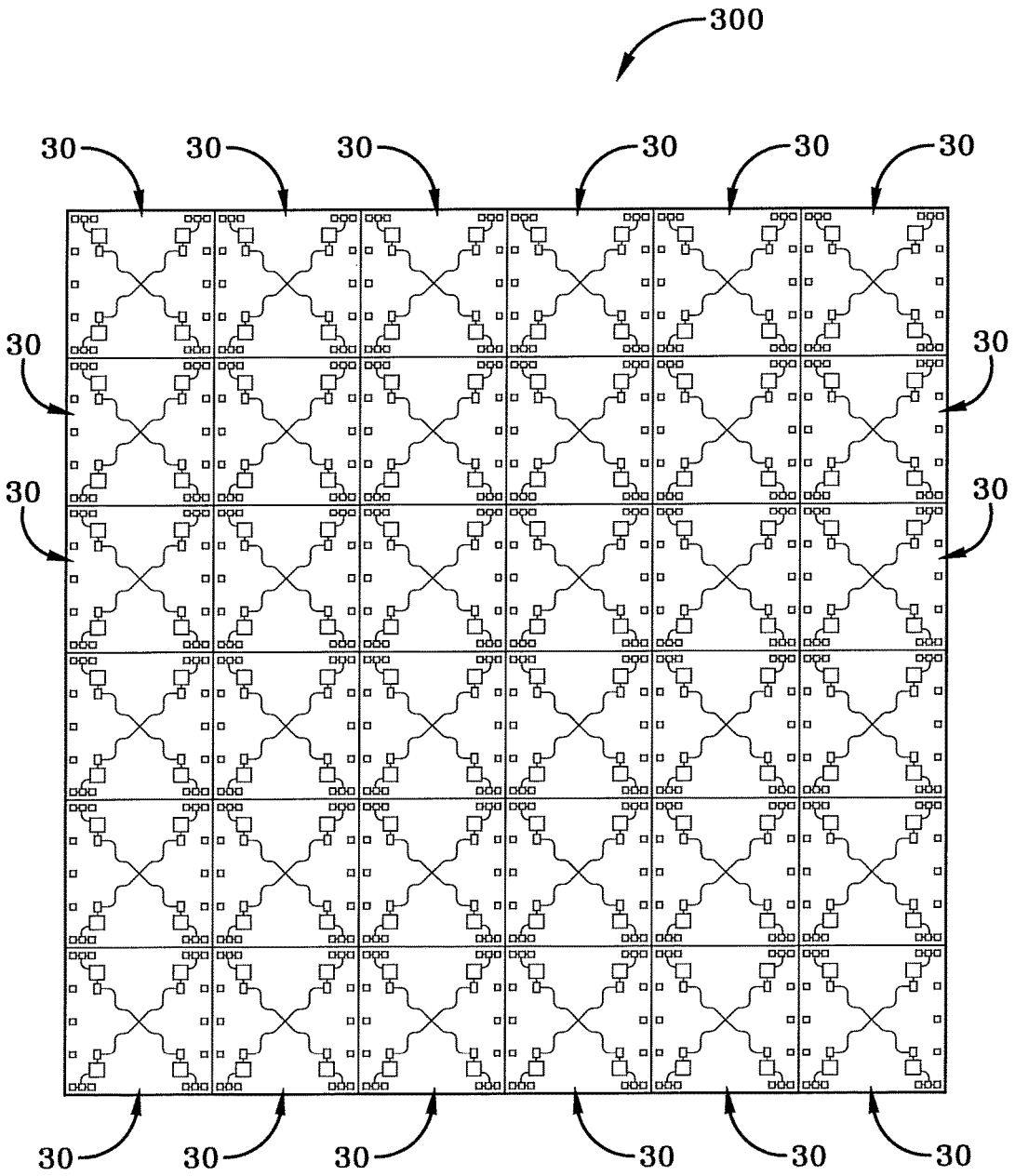
FIG. 6 is a schematic drawing showing a 6 by 6 tile array of the phased array antenna.

As depicted in FIG. 6, a 6×6 phased array antenna 300 is provided. The combination of 36 individual unit cell devices 30 together would form 6×6 phased array antenna 300. In another embodiment, integration of 6×6 phased array antenna 300 can form a panel of the reconfigurable phased array antenna which consists of several unit cell devices 30. The 6×6 phased array antenna 300 has central RF feed points which are connected through the backside vias and bring several control connections to the left and right edges of 6×6 phased array antenna 300. Preferably, the central RF feed is driven balanced at the connection points. Since 6×6 phased unit cell device 300 comprises several unit cell devices 30, it is possible to achieve reconfigurable 6×6 phased array antenna 300.

By way of non-limiting example, with 6×6 phased array antenna 300, if diagonal elements of quad switches on each unit cell device 30 are all "on", and all other switches on each unit cell devices 30 are "off", reconfigurable 6×6 phased array antenna 300 becomes a dipole shaped antenna. In a similar way, 6×6 phased array antenna 300 can be transformed from one shape to other shapes such as rhombic, patch, and spiral by simply controlling voltage flowing into floating pHEMT switches 14 on each unit cell devices 30. Furthermore, beam pointing angle 7 (FIG. 2) and polarization of the antenna 3 or 300 can be altered by the same manner.

Figure 7:
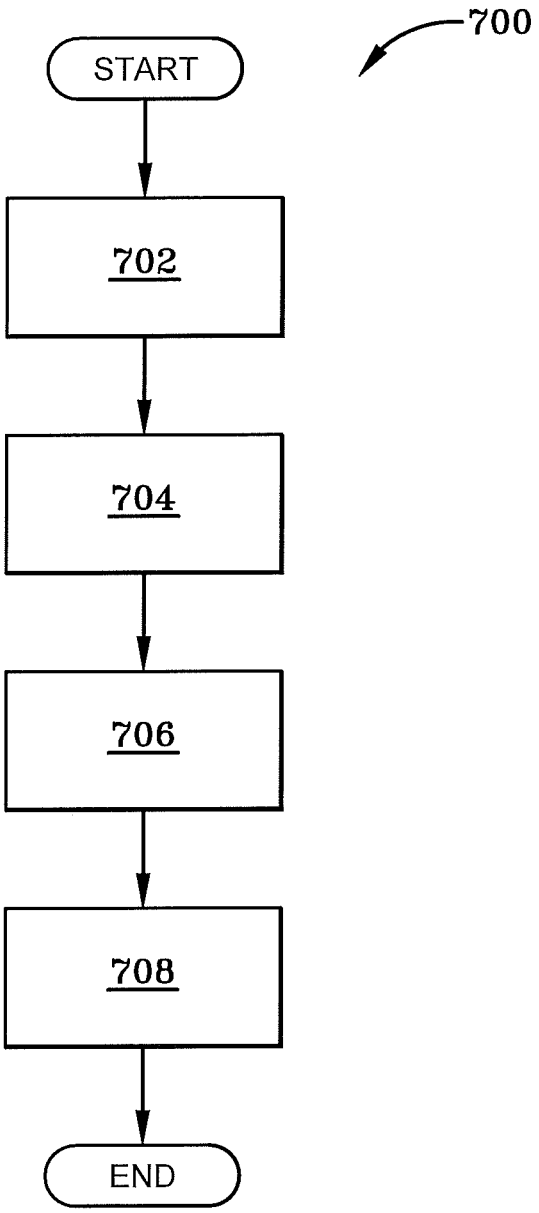
FIG. 7 is an exemplary flow chart for a method of use associated with the present disclosure.

As depicted in FIG. 7, a method 700 may include the steps of providing a reconfigurable phased array antenna including at least one floating switch 14, at least one RF connection port 12 operatively connected with the at least one floating switches, at least one radiating metal conductor 24 operatively connected to the at least one floating switch 14, and at least one control voltage pad 26 operatively connected to the at least one floating switch 14, shown generally at 702. Then, establishing a first configuration of the reconfigurable phased array antenna having a first current flow pattern, shown generally at 704. Then, reconfiguring the reconfigurable phased array antenna, shown generally at 706. Then, establishing a second configuration of the reconfigurable phased array antenna having a second current flow pattern different than the first current flow pattern, shown at 708.

While the present discourse has been described in connection with the preferred embodiments of the various figures, it is to be understood that other similar embodiments may be used or modifications or additions may be made to the described embodiment for performing the same function of the present discourse without deviating therefrom. Therefore, the present discourse should not be limited to any single embodiment, but rather construed in breadth and scope in accordance with the recitation of the appended claims.

What is claimed:

1. A reconfigurable phased array antenna having a plurality of antenna unit cell devices arranged in an array, wherein at least one unit cell device comprises:

a first floating switch;

a first radiating metal conductor operatively connected to the first floating switch;

a second floating switch;

a second radiating metal conductor operatively connected to the second floating switch;

a third floating switch;

a third radiating metal conductor operatively connected to the third floating switch;

a fourth floating switch;

a fourth radiating metal conductor operatively connected to the fourth floating switch; and a common cross junction including at least one bias voltage return resistor, wherein the first floating switch is connected in series with the common cross junction, the second floating switch is connected in series with the common cross junction, the third floating switch is connected in series with the common cross junction, and the fourth floating switch is connected in series with the common cross junction;

wherein the reconfigurable phased array antenna generates different antenna signal configurations by selectively interconnecting or disconnecting the first through fourth radiating metal conductors by respectively activating the first through fourth floating switches on the at least one unit cell device effectuating different electrical current flow patterns from an input voltage flowing into at least one floating switch.

2. The reconfigurable phased array antenna of claim 1, wherein for the at least one unit cell device in the array, each floating switch is a pseudomorphic high-electron-mobility (pHEMT) transistor.

3. The reconfigurable phased array antenna of claim 2, wherein for the at least one unit cell device in the array, each pHEMT transistor floating switch has a gate, a source, and a drain.

4. The reconfigurable phased array antenna of claim 3, wherein for each unit cell device in the array that receives an input voltage flowing into the gate of at least one floating switch, the electrical current flow pattern changes across that respective unit cell device in response to the first, second, third, and fourth floating switches turning on or off.

5. The reconfigurable phased array antenna of claim 3, wherein for the reconfigurable phased array antenna changes a beam pointing angle and a polarization in response to input voltage flowing on the gate of at least one floating switch in the at least one unit cell device.

6. The reconfigurable phased array antenna of claim 3, further comprising:

a first control voltage pad operatively connected to the first floating switch, wherein for the at least one unit cell device in the array, the gate of the first floating switch is operatively connected to the first control voltage pad;

a second control voltage pad operatively connected to the second flowing switch, wherein the gate of the second floating switch is operatively connected to the second control voltage pad;

a third control voltage pad operatively connected to the third flowing switch, wherein the gate of the third floating switch is operatively connected to the third control voltage pad; and a fourth control voltage pad operatively connected to the fourth flowing switch, wherein the gate of the fourth floating switch is operatively connected to the fourth control voltage pad.

7. The reconfigurable phased array antenna of claim 3, wherein at least one each unit cell device in the array, the source of the first floating switch is operatively connected to the first radiating metal conductor;

the source of the second floating switch is operatively connected to the second radiating metal conductor;

the source of the third floating switch is operatively connected to the third radiating metal conductor; and the source of the fourth floating switch is operatively connected to the fourth radiating metal conductor.

8. The reconfigurable phased array antenna of claim 7, wherein the at least one unit cell device in the array further comprises:

four direct current (DC) block capacitors;

wherein a first DC block capacitor is connected intermediate the source of the first floating switch and a first RF connection port;

wherein a second DC block capacitor is connected intermediate the source of the second floating switch and a second RF connection port;

wherein a third DC block capacitor is connected intermediate the source of the third floating switch and a third RF connection port; and wherein a fourth DC block capacitor is connected intermediate the source of the fourth floating switch and a fourth RF connection port.

9. The reconfigurable phased array antenna of claim 3, wherein for the at least one unit cell device in the array, the drain of the first floating switch is operatively is connected to a first RF connection port;

the drain of the second floating switch is operatively is connected to a second RF connection port;

the drain of the third floating switch is operatively is connected to a third RF connection port; and the drain of the fourth floating switch is operatively is connected to a fourth RF connection port.

10. The reconfigurable phased array antenna of claim 1, wherein the at least one unit cell device in the array further comprises:

a central RF feed, wherein each RF connection port is connected with the central RF feed.

11. The reconfigurable phased array antenna of claim 1, wherein the at least one unit cell device in the array further comprises:

a voltage source connected to each control voltage pad operatively coupled with each floating switch.

12. The reconfigurable phased array antenna of claim 1, wherein for the at least one unit cell device in the array, the common cross junction includes at least one bias voltage return metal interconnector, and at least one control return pad.

13. The reconfigurable phased array antenna of claim 12, wherein for the at least one unit cell device in the array, the at least one bias voltage return metal interconnector and the at least one bias voltage return resistor are connected to a common ground.

14. A reconfigurable phased array antenna having a plurality of antenna unit cell devices arranged in an array, wherein at least one unit cell device comprises:

a first floating switch;

a first RF connection port operatively connected with the first floating switch;

a first radiating metal conductor operatively connected to the first floating switch;

a first control voltage pad operatively connected to the first floating switch;

a second floating switch;

a second RF connection port operatively connected with the second floating switch;

a second radiating metal conductor operatively connected to the second floating switch;

a second control voltage pad operatively connected to the second floating switch;

a third floating switch;

a third RF connection port operatively connected with the third floating switch;

a third radiating metal conductor operatively connected to the third floating switch;

a third control voltage pad operatively connected to the third floating switch;

a fourth floating switch;

a fourth RF connection port operatively connected with the fourth floating switch;

a fourth radiating metal conductor operatively connected to the fourth floating switch;

a fourth control voltage pad operatively connected to the fourth floating switch; and a common cross junction including at least one bias voltage return resistor, wherein the first floating switch is connected in series with the common cross junction, the second floating switch is connected in series with the common cross junction, the third floating switch is connected in series with the common cross junction, and the fourth floating switch is connected in series with the common cross junction;

wherein the reconfigurable phased array antenna generates different antenna signal configurations by selectively interconnecting or disconnecting the first through fourth radiating metal conductors by respectively activating the first through fourth floating switches on the at least one unit cell device effectuating different electrical current flow patterns from an input voltage flowing into at least one floating switch.

* * * * *